US005131188A

United States Patent [19]

Hutchison et al.

[11] Patent Number: 5,131,188

[45] Date of Patent: Jul. 21, 1992

[54] AUTOMATIC RETURN MECHANISM FOR SLIDING DOOR OR WINDOW

[76] Inventors: Davie G. Hutchison; David M. Prochaska, both of 5216 Silver Bluff Dr., Oceanside, Calif. 92057

[21] Appl. No.: 724,822

[22] Filed: Jul. 2, 1991

[51] Int. Cl.[5] ..... E05D 15/06

[52] U.S. Cl. ..... 49/404; 16/72

[58] Field of Search ..... 49/404; 52/207; 160/90, 160/91; 16/72, 95

[56] References Cited

U.S. PATENT DOCUMENTS

| | | | |
|---|---|---|---|
| 2,735,675 | 2/1956 | Lindsey | 268/69 |
| 3,334,444 | 8/1967 | Hargrove | 49/404 |
| 4,003,102 | 1/1977 | Hawks et al. | 49/404 X |
| 4,004,372 | 1/1977 | Beard et al. | 49/404 |
| 4,126,912 | 11/1978 | Johnson | 49/404 X |
| 4,301,623 | 11/1981 | Demukai | 49/404 |
| 4,357,732 | 11/1982 | Hickman | 16/81 |
| 4,649,598 | 3/1987 | Kinsey et al. | 49/404 X |
| 4,819,295 | 4/1989 | Kaftan | 16/72 |
| 4,884,369 | 12/1989 | Tatham | 49/404 |
| 4,891,911 | 1/1990 | Yung | 49/404 |

*Primary Examiner*—Philip C. Kannan

*Attorney, Agent, or Firm*—Brown, Martin, Haller & McClain

[57] ABSTRACT

The invention described is a device or apparatus for automatically returning a sliding door or window to a predetermined position within a stationary frame, which incorporates a cable anchor on the frame; a hollow housing on the sliding closure having axially aligned elongated compartments in the housing, the more distant of which from the anchor is fluid-tight; a traveling block axially movably disposed in the closer compartment; a cable from the anchor reeved through sheaves in the traveling block; a tensioner connecting the traveling block with a partition between the compartments and biasing the traveling block away from the anchor to prevent shock in the system when slack is introduced into the cable by manual movement of the closure; the more distant compartment being divided into two fluid-tight chambers communicating at their adjacent ends; a rod longitudinally movably disposed through the traveling block and one chamber; a resilient compression device biasing the rod and the traveling block away from the anchor; a movable valve mounted on the rod to regulate fluid flow between the opposite ends of the chamber, the valve blocking or restricting longitudinal fluid flow within the chamber when the closure moves from the predetermined position and permitting flow when the closure moves toward the predetermined position; and the valve and fluid communication conduits cooperating to control the speed of movement of the rod urged by biasing of the compression device; whereby the closure is returned to the predetermined position at a preselected speed and without shock.

21 Claims, 2 Drawing Sheets

AUTOMATIC RETURN MECHANISM FOR SLIDING DOOR OR WINDOW

BACKGROUND OF THE INVENTION

1. Field of the Invention

The invention herein relates to sliding doors, windows and similar structures (hereinafter sometimes collectively referred to as "closures"). More particularly it relates to mechanisms for automatically closing such closures.

2. Description of Background Information

Sliding doors and windows are a feature of many homes, hotels, motels and recreational buildings. Most commonly, such doors and windows are formed in two or more parts which are fitted into a fixed frame, a fixed portion and a movable or "sliding" portion which moves in a track parallel to the fixed portion and is retracted across the fixed portion to enable a maximum of one-half of the doorway or window area to be opened. The movable part of the door or window normally slides horizontally. (The doors and windows are commonly termed "sliding", and in fact most of the windows, particularly in the smaller sizes, do slide in the tracks formed in the window frame. The large windows, and almost all of the doors, do not actually slide but rather roll on small wheels or casters which are fitted into the bottom rail of the door or window and roll in the tracks in the door or window frame. However, the common terminology of the industry is to label all of these as "sliding." However, as will be evident from the description below, the invention herein is most useful with those "sliding" doors and windows which actually roll on the small casters.)

(For brevity herein, the present invention and the background thereof will usually be described hereafter in conjunction with a sliding door such as a patio door. As will be noted below, however, it will be understood that the discussion is also applicable to sliding windows and other types of sliding or rolling doors besides patio doors, such as freezer locker doors, garage doors and the like.)

Because the doors move horizontally to open, they commonly remain in an open position unless manually closed, since there is no biasing, gravitational or other force to tend to return the door to the closed position. Persons in a hurry, or otherwise distracted, often unintentionally leave the doors open by being to rushed or forgetful to stop and close the door after opening and passing through it, even when that is unintended. However, such opened doors (or windows) cause significant problems.

1. Energy conservation—Opened doors and windows are major energy wasters. In the summer months cool air from an air conditioned room is lost through an opened door or window, thus requiring the air conditioning system to run longer and harder to make up the loss. Similarly, heated warm air in the winter is lost through opened doors and windows, again causing the heating system to run longer and harder to keep the house warm.

2. Personal and property security—An opened door or window is an invitation to prowlers to enter the home or for thieves to enter a hotel or motel room.

3. Physical safety—Sliding doors are commonly used in patio and courtyard areas, particularly in homes and motels, and often open directly to swimming pools, such as the backyard pools at many residences in the "Sunbelt" states from California to Florida. It is a tragic fact that each year many toddlers and small children wander unsupervised through open sliding patio doors into pool areas, fall into the pools and are drowned or, even if rescued, suffer severe brain damage from near drowning.

For these and other reasons, there has been considerable effort to develop mechanisms which can be attached to or incorporated into sliding doors and windows to cause the doors and windows to automatically be closed after they are opened to allow passage through the doorway. A wide variety of different kinds of mechanisms have been suggested to provide such automatic closure. However, all of the previous devices have had one or more of a variety of disadvantages:

1. Unsightly appearance, cumbersome in use, or difficult to attach to or incorporate into the door frame.

2. Reliance upon gravity to operate the mechanism, normally with activated by use of a suspended weight. This requires that the mechanism be disposed substantially vertically, which in many cases may not be possible or desirable.

3. Easily damaged or at least rendered temporarily inoperable if the door is deliberately or inadvertently closed by hand.

4. Lack of means for readily controlling the rate of closure, such that when new the doors may close faster than desired and when older may close more slowly than desired. In fact, older doors often do not close at all due to increased friction from worn caster wheels, dirt and oxidation in the track, and settling and warpage of the door frame.

Typical examples of prior art devices for door and window closure, each of which will be found to exhibit one or more of the above disadvantages, are found in U.S. Pat. Nos. 4,003,102 (Hawks et al.); 4,126,912 (Johnson); 4,884,369 (Tatham); and 4,891,911 (Yung). Numerous other examples may also be found in the patent and trade literature.

The need for reliable, efficient, and controllable door and window closing mechanisms has become imperative. Energy conservation demands that doors and windows be kept closed when heating and air conditioning systems are in operation. Personal and property security demands that doors and windows be kept closed to discourage entry by vandals and criminals. Finally, child safety demands that doors and windows be automatically closeable so that youngsters will not stray out of their houses into the dangers of unsupervised swimming pools, street traffic and other hazardous environments. In fact, to this latter end many states and municipalities have enacted or are considering laws and ordinances which require that homes, motels and other buildings where swimming pools are present be built with automatic door closers as a required part of the structure under the applicable building codes. It has also been proposed that existing structures where pools are present be required to be retrofitted with automatic door and window closing mechanisms. Consequently, the availability of an efficient, reasonably priced and controllable door and window closing system would be extremely advantageous and would overcome many of the objections that home owners, home buyers, contractors and the like currently have to installing and using the prior art devices currently available.

SUMMARY OF THE INVENTION

The invention herein is a device or apparatus for automatically returning a sliding closure (e.g., a door or window) to a predetermined position within a stationary frame, comprising a cable anchor on the frame; a hollow housing on the sliding closure having a plurality of fixed partitions therein defining first and second axially aligned elongated compartments in the housing, the second compartment being more distant from the anchor and fluid-tight; a traveling block axially movably disposed in the first compartment; a cable from the anchor reeved through at least one sheave in the traveling block and secured to the partition closest to the anchor, such that as the closure is moved from the predetermined position, the traveling block is drawn toward the anchor; a tensioner connecting the traveling block with an intermediate partition between the first and second compartments and biasing the traveling block away from the anchor to prevent shock in the system when slack is introduced into the cable by manual movement of the closure; a longitudinal septum dividing the second compartment into first and second fluid-tight chambers having fluid communication conduits between their adjacent ends; a rod longitudinally movably disposed through the traveling block and the intermediate partition into the first chamber, travel of the rod bounded by the side of the traveling block away from the first chamber; resilient compression means biasing the rod and the traveling block away from the anchor; a movable valve mounted on the rod to regulate fluid flow between the opposite ends of the first chamber, the valve blocking or restricting longitudinal fluid flow within the first chamber when the closure moves from the predetermined position and permitting flow when the closure moves toward the predetermined position; and the valve and the fluid communication conduits cooperating to control the speed of movement of the rod urged by biasing of the resilient compression means; whereby the closure is returned to the predetermined position at a preselected speed and without shock.

In preferred embodiments, the closure is a door or window, the tensioner and the resilient compression means are springs, and/or the sheaves and blocks provide multiple-fold purchase.

Portions of the invention herein are identified as "fluid-tight" and the system itself is in part "fluid-flow controlled." The system is preferably a hydraulic system and the "fluid" is a conventional hydraulic liquid such as light oil, commercial hydraulic fluid or water. Alternatively the system may be a pneumatic system, in which the "fluid" is a gas, preferably air, nitrogen or argon, but if desired other gases, such as carbon dioxide, could be used. Of course one would select fluids which are non-toxic to users of the equipment and inert to the metal, rubber and other components of the apparatus, or which could be made so by addition of minor amounts of anti-corrosion additives or the like. In the description below, the system will be illustrated as a hydraulic system, and the fluid will be exemplified as commercial hydraulic fluid. It will of course be understood that this illustrative system is not limiting of the scope of the invention.

BRIEF DESCRIPTION OF THE DRAWINGS

FIG. 10 is an illustration of the apparatus of this invention installed in the frame of the closure.

FIGS. 11 and 12 illustrate alternative forms of the tensioner used in the present invention.

DETAILED DESCRIPTION AND PREFERRED EMBODIMENTS

As noted above, the mechanism of the present invention will be described in conjunction with a sliding door such as a patio door, it will be understood that the mechanism of this invention can be also used with sliding windows and with other types of sliding or rolling doors besides patio doors, such as freezer locker doors, garage doors, pocket doors, wardrobe doors and the like. Further, the mechanism will be described as a door closing mechanism, since that will be its principal contemplated use. It will again be recognized, however, that in those very limited situations where it is desired to have a door or window automatically return to an open position after being closed, reversal of the mechanism herein can serve to automatically open such a door or window.

Figure 1:
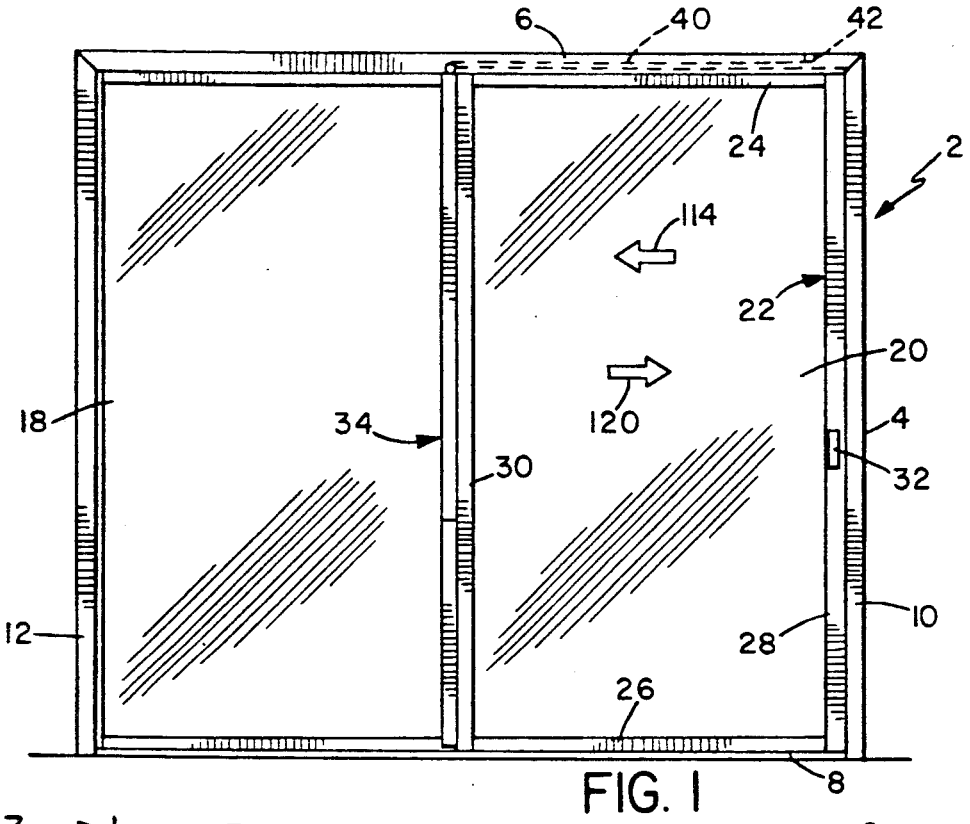
FIG. 1 illustrates a typical sliding door structure with the apparatus of this invention installed on the door frame.
Figure 2:
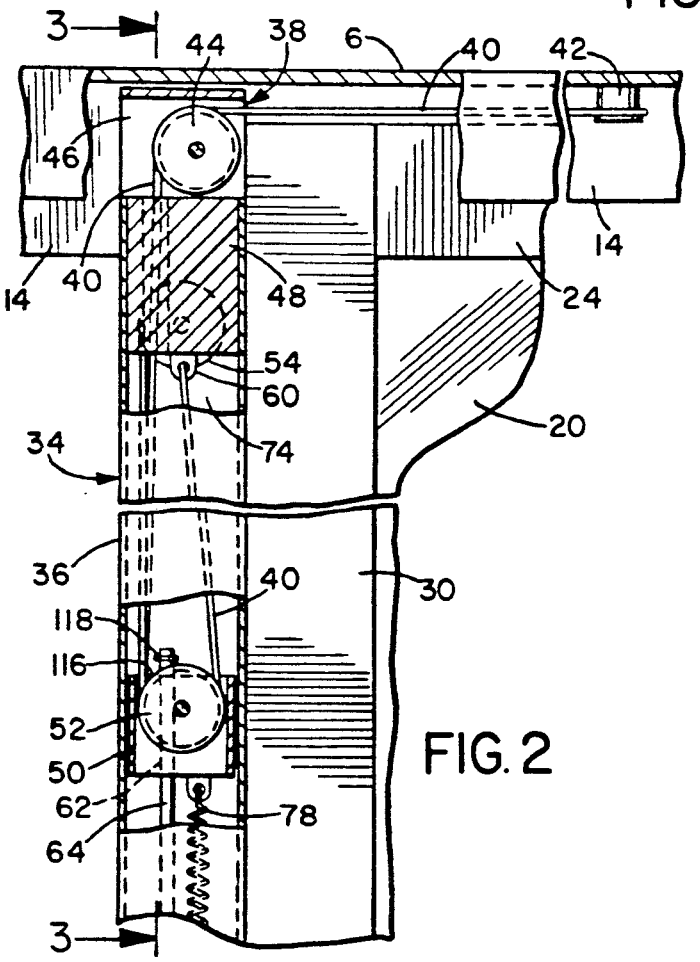
FIG. 2 is an enlarged side elevation view of the upper portion of the apparatus of this invention, with portions shown cut away.
Figure 4:
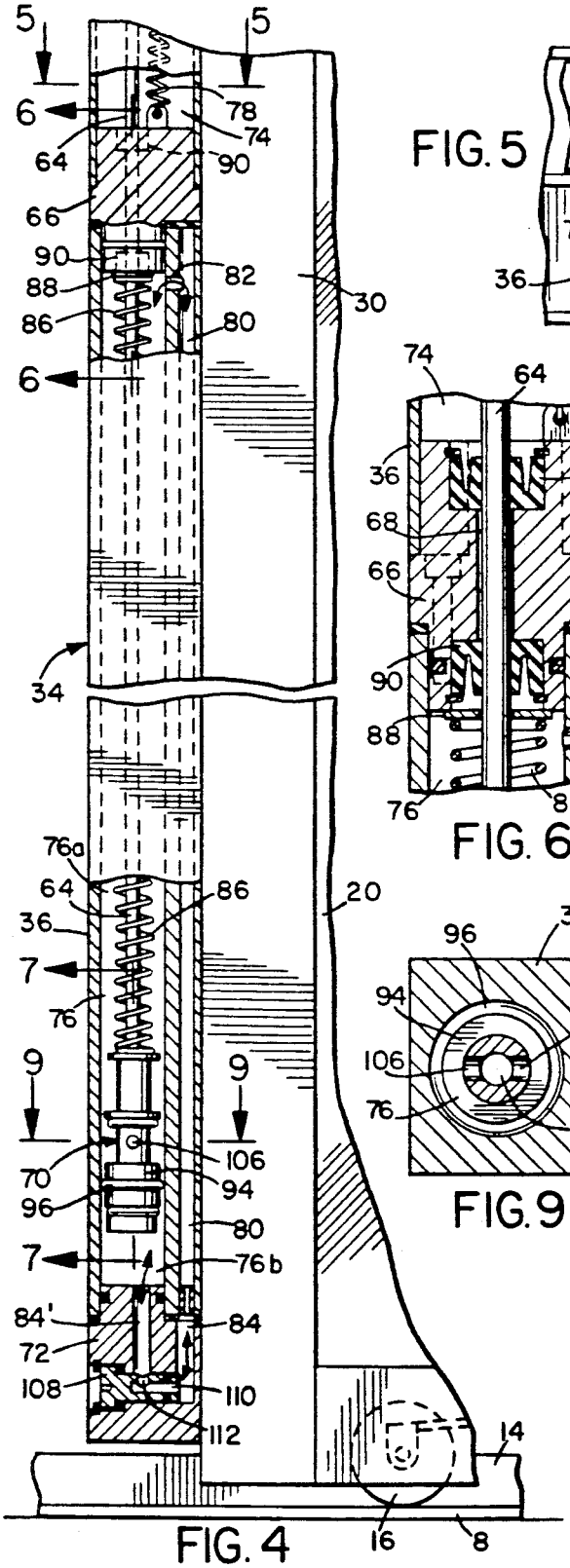
FIG. 4 is an enlarged side elevation view of the lower portion of the apparatus of the present invention with portions cut away.
Figure 5:
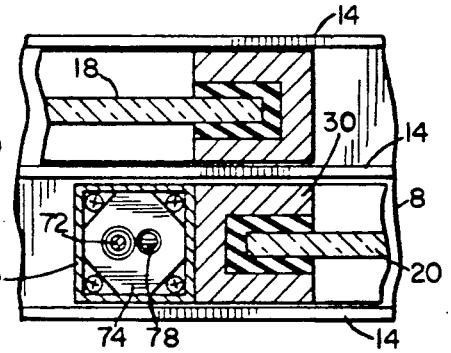
FIG. 5 is a sectional view taken on Line 5—5 of FIG. 4.
Figure 6:
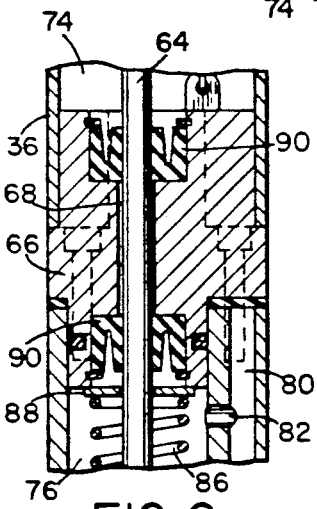
FIG. 6 is an enlarged sectional view taken on Line 6—6 of FIG. 4.

The invention herein will be best understood by reference to the drawings. FIG. 1 illustrates a typical sliding patio door such as is found in many homes, motels and the like. The outer portion of the door 2 comprises door frame 4 which is formed by top rail 6, bottom rail 8 and side rails 10 and 12. All of the rails normally are divided into a plurality (usually two or three) parallel tracks separated by dividers 14, as shown in FIG. 4, such that each portion of the door, including any outside screen portion, has its own track in which to run. Normally the movable panels of the door will ride on caster wheels 16 on the lower rail 8 and often also on the upper rail 6 (using similar caster wheels not shown).

Fitted within the frame 4 are at least two panels, one of which is fixed and the other of which is movable. The fixed panel 18 usual occupies one-half of the door space, although configurations in which there are three or more panels, with at least two being movable and the remainder fixed, are not uncommon. Since the apparatus of the present invention is applicable to each movable door panel individually, however, the total number of such movable panels in a particular door frame is not important, since each will be opened or closed independently. The fixed panel 18 may be filled as shown in FIG. 1 by ordinary glazing, or by specialty glass or other types of panel materials, such as translucent plastics, screening, or even thin metal or wood panels.

Also mounted in door frame 4 is movable door panel 20. This movable panel 20 is formed by panel frame 22 which comprises top and bottom channels 24 and 26 and side channels 28 and 30. For differentiation herein, channel 28 will be termed the "leading" edge or channel and will be identified by having the door handle or pull 32 mounted thereon, while the opposite channel 32 where the major portion of the mechanism of this invention is located will be termed the "trailing" channel or edge. The interior of the movable panel 20 may be of the same or different material as that of the fixed panel 18; i.e. glass, wood, metal, screen, or plastic. Most commonly the two panels 18 and 20 are formed of glass or screen. It is also very common to have additional parallel movable panels, usually of glass (e.g., a storm door) or of either screen (a screen door). Also commonly, such movable panels are removable from the door frame 4 for cleaning, repair, maintenance or replacement The closure mechanism of the present invention is illustrated in FIG. 1 as being mounted vertically on the outside of trailing channel 30 and is designated 34. As will be discussed below, however, it will be recognized that the apparatus 34 can also be mounted interiorly of channel 30, as illustrated in FIG. 10. It can also be mounted other than vertically, which is a property unique to the present invention as compared to prior art devices.

Considering now FIGS. 2–9, one will understand the structure and operation of the present apparatus. Most of the apparatus is encased in housing 36 which is shown attached to trailing channel 30. It will be understood, however, that alternatively housing 36 and channel 30 can be combined as a single integrated unit.

Figure 3:
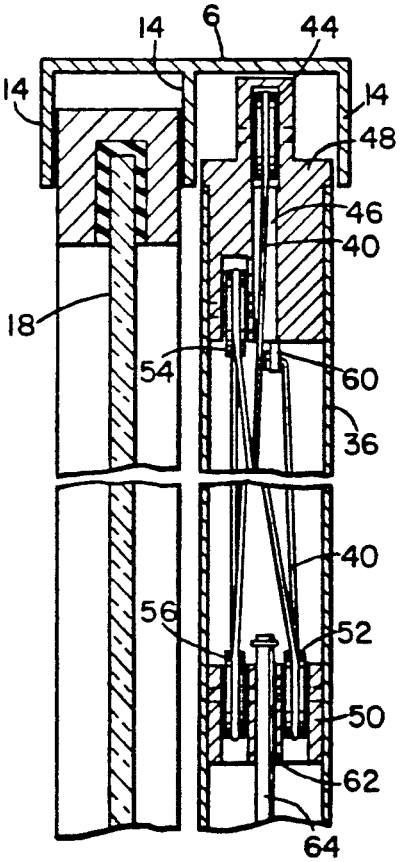
FIG. 3 is a sectional view taken on Line 3—3 of FIG. 2.

Housing 36 extends from the top of the moveable panel 20 generally down the entire vertical height of the movable panel 20, although it may be foreshortened at the bottom if desired. At the top housing 36 extends slightly above the frame channels 30 and 24 as shown at 38 to accommodate cable 40. Cable 40 is anchored at a fixed position 42 on the interior of door frame 4, usually on the inside of upper channel 6 near the fully closed position of the moveable panel 20. Cable 40 is disposed substantially horizontally in rail 6 from anchor 42 over to sheave 44 which is journalled in an opening 46 in the partition 48 which fills the upper end of conduit 36. The free end of cable 40 is reeved around sheave 44 to assume a substantially vertical orientation into housing 36 to travelling block 50, which is disposed below partition 48 in housing 36 and which contains sheave 52. Partition 48 thus serves as a fixed block which in combination with traveling block 50 forms a ordinary block-and-tackle system. Cable 40 can be reeved around sheave 52 and carried back for securement to partition 48 to form a single purchase block and tackle. More preferably, however, a multiple purchase system is desired, such as is illustrated in FIG. 3 utilizing sheaves 54 and 56 around which the cable 40 is reeved to a cable anchorage, as at 60 on partition 48. The multiplication of force and the corresponding decrease in linear movement of the travelling block 50 can be easily calculated from common block and tackle engineer principles found widely described in the literature. The multiple purchase arrangement shown in FIGURE 3 has been found to be particularly preferred in terms of providing adequate closing force while limiting vertical movement of the travelling block 50.

Travelling block 50 has a vertical hole 62 formed therethrough in which is disposed the upper end of rod 64. Rod 64 extends vertically through travelling block 50 and then through central partition 66 (via vertical hole 68) and terminates in valve 70 near the lower end of housing 36 in chamber 76. Upper partition 48, central partition 66 and lower partition 72 are fixed in position and in combination form respectively internal chambers 74 and 76 within housing 36. Lower chamber 76 is fluid tight, being sealed at each end by partitions 66 and 72 respectively.

Connecting the bottom of travelling block 50 and central partition 66 is a tensioner, here illustrated as a tension spring 78. As will be discussed below, the tensioner may be a tension spring 78, a rubber band 78', a gas spring 78" or similar tension biasing device which allows the door to be closed fully or partially by hand without the problem of shock or bounce of prior art doors, by compensating for the slack in cable 40 when the movable panel 20 of the door is moved manually.

Running parallel to chamber 76 within the lower portion of housing 36, and also sealed at its ends by partitions 66 and 72, is a fluid-tight relief channel 80. Chamber 76 and channel 80 are linked near their ends by fluid conduit channels 82 and 84 respectively.

Within chamber 76 rod 64 is surrounded by resilient device 86 (hereafter exemplified by a compression spring), which is seated at its upper end against washer 88 which rests on the bottom edge of partition 66. Where rod 64 passes through partition 66 it is sealed against fluid flow by shaft seals 90.

Figure 7:
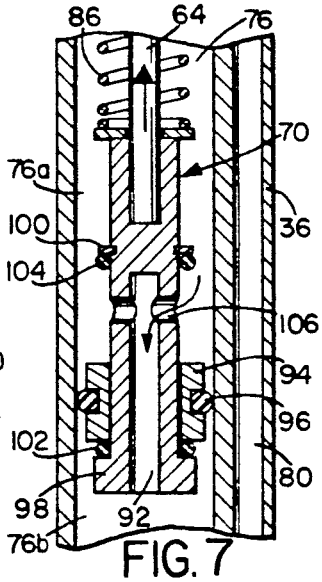
FIG. 7 is an enlarged sectional view taken on Line 7—7 of FIG. 4, with the speed control valve shown in the door closing position.
Figure 9:
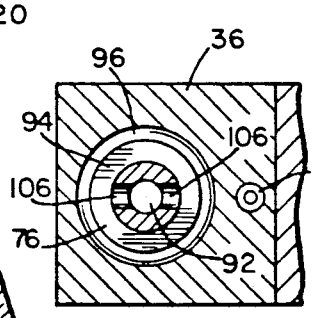
FIG. 9 is an enlarged sectional view taken on Line 9—9 of FIG. 4.
Figure 8:
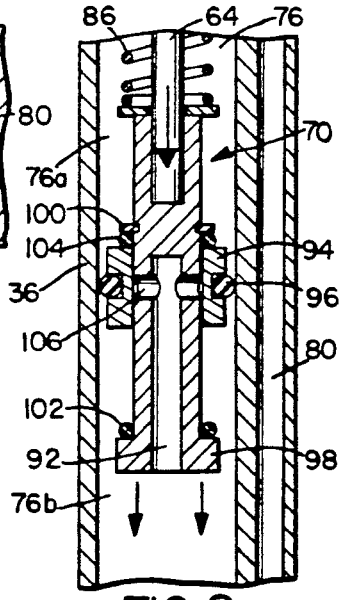
FIG. 8 is a view similar to that of FIG. 7, but with the valve shown in the door opening position.

At its lower end rod 64 terminates in valve 70, against which the other end of compression spring 86 is seated. Valve 70 comprises an elongated member which is partially hollow having in the lower end thereof fluid channel 92. Surrounding the lower portion of valve 70 is sliding collar 94 which has a circumferential groove in which is seated O-ring 96, which seals valve 70 against the inner walls of chamber 76 and effectively divides chamber 76 into an upper portion **76*a* and a lower portion 76*b*. The range of vertical travel of collar 94 is limited by shoulder 98 at the bottom of valve 70 and ring 100 near the middle of valve 70. O-rings 102 and 104 serve to cushion the contact between sleeve 94 and shoulder 98 or ring 100 respectively and to seal against fluid leakage when the sleeve is at the extremes of its travel as shown in FIGS. 7 and 8**.

Channel 92 is in intermittent fluid contact with upper portion **76*a* of chamber 76 through openings 106 in valve 70. When rod 64 is moving downward sleeve 94 is forced upward and closes off openings 106, which prevents fluid passage from lower portion 76*b* through channel 92 into upper portion 76*a***.

Also present in lower partition 72 and mounted within fluid conduit 84 is regulating valve 108. As shown in FIG. 4, this is commonly simply a threaded rotatable bolt which has an internal partial fluid passage 110 which is open at one end to a portion of channel 84 and has a opening 112 at the opposition end which can be moved into or out of alignment with the other portion of channel 84 (here designed 84') by rotation of the bolt.

The operation of the present device is now readily described with reference to the prior designated structures and components. Considering the door of FIG. 1 as being an exterior door as viewed from the inside of a room and the mechanism as hydraulic fluid-filled, the door when being opened moves to the left as indicated by arrow 114. Since the cable 40 is fixed to anchor 42, as the door moves to the left cable 40 causes travelling block 50 to be raised within the housing 36. As travelling block 50 rises, its upper surface 116 contacts ring 118 which is clamped about the periphery of the top of rod 64 and pulls rod 64 upward with it. As rod 64 moves upward, sleeve 94 moves downward relative to valve 70, exposing hole 106 and allowing for free passage of hydraulic fluid from chamber 76*a* into chamber 76*b* as indicated in FIG. 7. The amount of distance that the travelling block 50 and the rod 64 move upward will be determined by the number of falls of cable 40 reeved between upper partition 48 and travelling block 50.

When the door reaches the maximum amount to which it is to be opened, travelling block 50 and rod 64 will be at their highest point, tensioner 78 will be at its most extended length and compression spring 86 at its most compressed length. When the door stops, the forces in both springs act to begin retracting travelling block 50 and rod 64, with the ring 118 on rod 64 also serving to transmit the driving force of compression spring 86 to travelling block 50. As the rod 64 and travelling block 50 move downward, they pull on cable 40 and cause door panel 20 to start moving back to the right as indicated by arrow 120.

Simultaneously, the friction of O-ring 96 against the interior wall of chamber 76 causes sleeve 94 to resist the downward motion until the body of valve 70 has moved through it to bring it into contact with O-ring 104 and to block hole 106 as shown in FIG. 8. This in turn prevents hydraulic fluid transfer directly from chamber 76*a* into chamber 76*b* through valve 70. As rod 64 and sleeve 94 move further downward under the force of compression spring 86, the hydraulic fluid in chamber 76*b* serves to retard the downward motion of rod 64 and regulates the pull on travelling block 50 and cable 40, thus controlling the closure speed of the door panel 20. In order to permit the desired degree of motion against the hydraulic fluid, there is some pressure relief from chamber 76*b* through channel 84 and valve 108. The degree to which valve 108 is turned and the hydraulic fluid flow access from channel 84' through opening 112 into channel 110 will determine how fast the pressure is relieved by hydraulic fluid flow through channel 80 and hole 82 into chamber 76*a* and in turn how much back pressure is maintained against the downward movement of rod 64, valve 70 and sleeve 94. If valve 108 is turned such there is free flow of the hydraulic fluid through the valve the rod 64 will move down rapidly and the door panel 20 will close rapidly. Conversely, if the valve 108 is relatively closed the rod 64 will move slowly and the door panel 20 will close slowly. Once the door panel 20 reaches its closed position the motion of the rod 64 and travelling block 50 will stop and the hydraulic fluid flow between chambers 76*b* and 76*a* will gradually equilibrate through valve 108, even though the resistance of O-ring 96 will normally keep sleeve 94 positioned over holes 106 until the subsequent upward motion of the rod when the door is next opened.

If the door is closed manually faster than the automatic closure rate of the device of this invention, the cable 40 will be shortened between anchor 42 and sheave 44. If there is no compensation for this movement, slack will develop in that section of cable 40 between anchor 42 and sheave 44, and the slack cable could become entangled in the door channel 24 or the door frame rail 6, causing the door to became jammed. Therefore, it is necessary to provide for compensation for such motion, by having automatic means of taking up any slack created when the door is closed manually, to prevent shock in the system. This is accomplished by tensioner 78. When the door is closed manually and the cable becomes foreshortened between anchor 42 and sheave 44, the pull on travelling block 50 is reduced and travelling block 50 is free to move downward. Tensioner 78, which is anchored to travelling block 50, provides sufficient force to pull travelling block 50 downward at a rate which precisely compensates for the amount of excess cable 40 being reeved past sheave 44. This is ensured by having tensioner 78 of sufficient strength that it can overcome any frictional resistance to the downward movement of the travelling block 50, so that no matter how much excess cable 40 is reeved past sheave 44, the tensioner 78 will continue to pull on travelling block 50. It of course cannot exceed the closure rate of the door panel 20, since it cannot pull the travelling block 50 any farther than the taut length the cable permits.

Most importantly, tensioner 78 allows the door to be closed (fully or partially) manually without creating shock in the system from the free fall of travelling block 50 when slack is introduced into the cable 40 by the manual movement of the door panel 20. With the presence of the unique tensioner 78, one can manually move the door of this invention with the assurance that tensioner 78 will allow the system to "catch up" smoothly with the door movement and avoid the shock effect common to prior art closures.

In the embodiment illustrated, the mechanism is described in its most preferred form, which is in the vertical position attached to the frame of door panel 20. As noted, in an equally preferred version, the mechanism would be disposed within the channel 30 of the door panel 20, also in a vertical position. However, unlike the devices of the prior art, since this mechanism does not rely on gravity for any motion but rather is entirely driven by the force of compression spring 86 and tensioner 78 and regulated by controlling the fluid flow in chambers 76*a* and 76*b*, the device can work equally well at any orientation, including horizontal. Thus, for instance, it would be possible to build such a mechanism into the top channel 24 of door panel 20 or into the top rail 6 of door frame 4. The former configuration, in channel 24, could be accomplished by keeping sheave 44 located at the farthest point of the door frame from anchor 42 and orienting the remainder of the mechanism back in the direction toward the anchor 42. In the latter configuration, with the mechanism disposed in door frame rail 6, there would have to be sufficient clearance for the panel 20 to be properly retracted so that the distance between anchor 42 and sheave 44 would be substantially extended. The ability to place the device in an orientation other than vertical also permits use in a unique architectural configurations, as where for design purposes the door panel 20 may be other than a rectangular shape. For instance, the bottom channel 26 could be longer than the top channel 24 and side channel 30 could be oriented at an angle so that the door panel itself was in a form of a truncated trapezoid.

It will be evident that there are numerous embodiments of the apparatus of this invention which, while not expressly described above, are clearly within the scope and spirit of this invention. The above description is therefore intended to be exemplary only and the full scope of the invention is to be determined solely by the appended claims.

We claim:

1. Apparatus for automatically returning sliding closure to a predetermined position within a stationary frame, comprising:

a cable anchor on said frame;

a hollow housing on said sliding closure having a plurality of fixed partitions therein defining first and second axially aligned elongated compartments in said housing, said second compartment being more distant from said anchor and fluid-tight;

a traveling block axially movably disposed in said first compartment;

a cable from said anchor reeved through at least one sheave in said traveling block and secured to said partition closest to said anchor, such that as said closure is moved from said predetermined position, said traveling block is drawn toward said anchor;

tensioning means connecting said traveling block with an intermediate partition between said first and second compartments and biasing said traveling block away from said anchor and adapted to prevent shock in the system when slack is introduced into the cable by manual movement of the closure;

a longitudinal septum dividing said second compartment into first and second fluid-tight chambers having fluid communication conduits between their adjacent ends;

a rod longitudinally movably disposed through said traveling block and said intermediate partition into said first chamber, travel of said rod bounded by the side of said traveling block away from said first chamber;

biasing means biasing said rod and said traveling block away from said anchor;

a movable valve mounted on said rod to regulate fluid flow between the opposite ends of said first chamber, said valve blocking or restricting longitudinal fluid flow within said first chamber when said closure moves from said predetermined position and permitting flow when said closure moves toward said predetermined position; and said valve and said fluid communication conduits cooperating to control the speed of movement of said rod urged by biasing of said second biasing means; whereby said closure is returned to said predetermined position at a preselected speed.

2. Apparatus as in claim 1 wherein the cross-sectional area of said first chamber is larger than that of said second chamber.

3. Apparatus as in claim 1 wherein said tensioner comprises a gas spring.

4. Apparatus as in claim 1 wherein said tensioner comprises a tension spring.

5. Apparatus as in claim 1 wherein said tensioner comprises a rubber band.

6. Apparatus as in claim 1 further comprising adjustable control means within at least one of said fluid communication conduits to permit regulation of fluid flow within said conduit.

7. Apparatus as in claim 6 wherein said control means comprises a valve in said conduit.

8. Apparatus as in claim 1 wherein said partition closest to said anchor forms a fixed block with at least one sheave disposed therein through which said cable is reeved.

9. Apparatus as in claim 8 wherein said fixed block and said traveling block form at least a double tackle.

10. Apparatus as in claim 1 wherein said housing is mounted on said closure.

11. Apparatus as in claim 10 wherein said housing is disposed substantially vertically.

12. Apparatus as in claim 10 wherein said closure is bounded by a closure frame and said housing is attached to an edge of said closure frame.

13. Apparatus as in claim 12 wherein said closure comprises a door.

14. Apparatus as in claim 12 wherein said closure comprises a window.

15. Apparatus as in claim 1 wherein said housing is within said closure.

16. Apparatus as in claim 15 wherein said housing is disposed substantially vertically.

17. Apparatus as in claim 15 wherein said closure is bounded by a closure frame and said housing is disposed within a side of said closure frame.

18. Apparatus as in claim 17 wherein said closure comprises a door.

19. Apparatus as in claim 17 wherein said closure comprises a window.

20. Apparatus as in claim 1 wherein said biasing means comprises resilient compression means.

21. Apparatus as in claim 20 wherein said resilient compression means comprises a compression spring.

* * * * *